United States Patent [19]

Witecki

[11] 3,934,343

[45] Jan. 27, 1976

[54] DEVICE FOR CUTTING CIRCLES

[75] Inventor: Jacek Witecki, Downsview, Canada

[73] Assignee: Lawrence Peska Associates, Inc., New York, N.Y. ; a part interest

[22] Filed: Oct. 30, 1974

[21] Appl. No.: 519,119

[52] U.S. Cl. ..... 30/310; 33/27 B

[51] Int. Cl.[2] ..... B26B 5/00; B43L 9/02

[58] Field of Search ..... 30/310; 33/27 B, 27 C

[56] References Cited

UNITED STATES PATENTS

| | | | |
|---|---|---|---|
| 683,809 | 10/1901 | Starr | 33/30 A |
| 719,381 | 1/1903 | Seymour | 33/27 B |
| 1,511,016 | 10/1924 | Barker | 30/310 X |
| 2,655,727 | 10/1953 | Varona et al. | 33/27 B |

FOREIGN PATENTS OR APPLICATIONS

| | | | |
|---|---|---|---|
| 1,080,510 | 6/1954 | France | 33/27 B |

*Primary Examiner*—Al Lawrence Smith
*Assistant Examiner*—J. T. Zatarga
*Attorney, Agent, or Firm*—Jack D. Slobod

[57] ABSTRACT

Disclosed is a device for cutting circles and the like consisting essentially of an adapter for mounting on one leg of a compass and into which is threaded a blade holder provided with a blade.

3 Claims, 4 Drawing Figures

FIG. 1
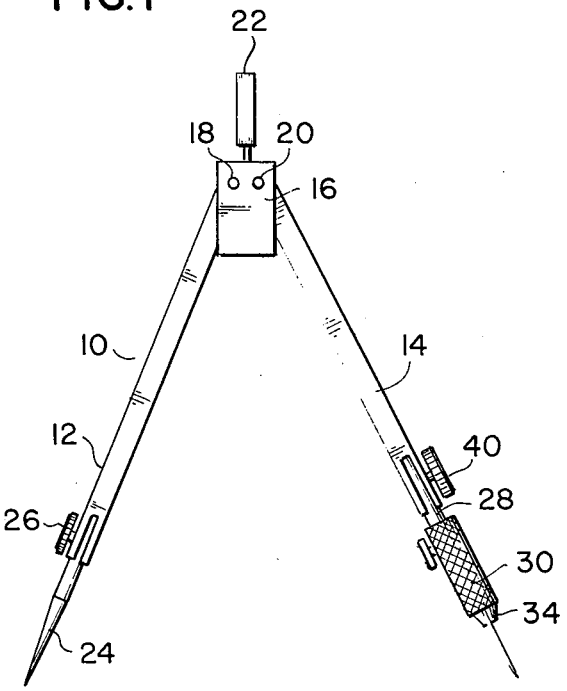
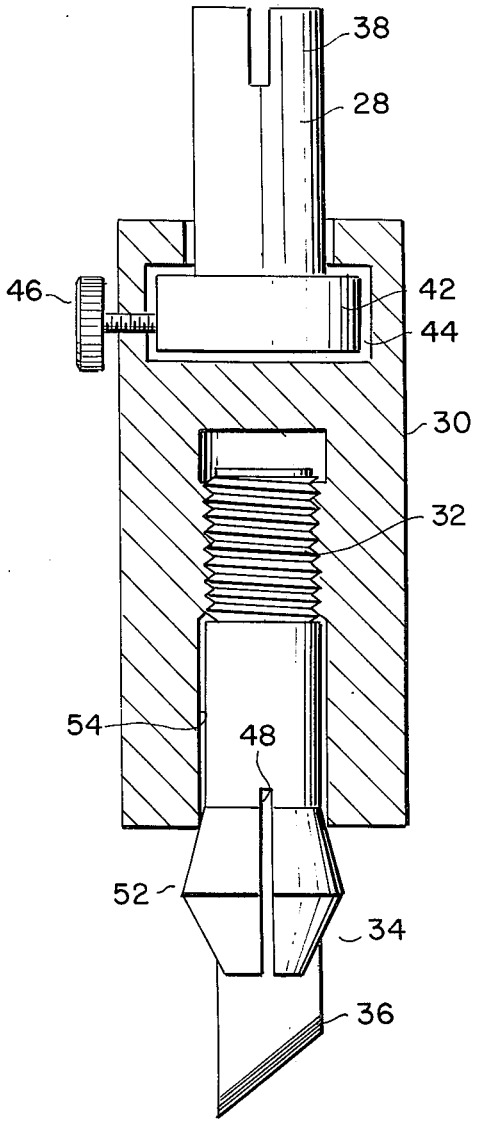
FIG. 2
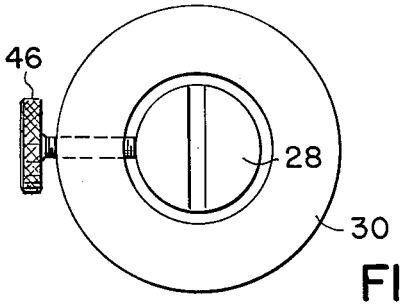
FIG. 3
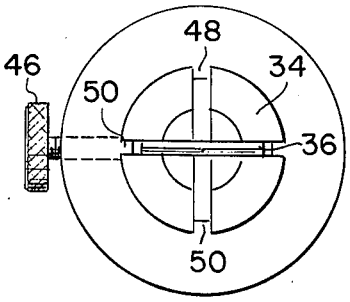
FIG. 4

DEVICE FOR CUTTING CIRCLES

BACKGROUND OF THE INVENTION

FIELD OF THE INVENTION

The present invention relates to a compass-like device for cutting circular pieces of very accurate dimensions from sheets of paper, cardboard, plastic, leather and the like.

While many devices of this character have heretofore been proposed they have been so complex in structure as to be prohibitively expensive.

STATE OF THE ART

The art to which this invention relates already is aware of the following U.S. Pat. Nos.: 3,335,497; 3,098,304; 3,394,460; and 2,943,392. The structures described in these patents are either of the drop compass type to which a cutting member has been added or of the beam compass type or yet mechanical improvements in simple scribing compasses.

The principal object of this invention is to provide a device or article of this character which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

In the accompanying drawing, in which is shown one of the various possible illustrative embodiments of this invention, wherein like reference character identify the same or like parts:

FIG. 1 is a front elevational view of a device embodying features of the invention;

FIG. 2 is a detailed view in section of the cutting assembly of the device;

FIG. 3 is a top view of the assembly; and

FIG. 4 is a bottom view thereof.

With reference to the drawing, there is shown and illustrated a cutter constructed in accordance with the principles of the invention and designated generally by reference character 10.

Referring to the drawing, the device 10 includes a pair of elongated tubular legs 12 and 14 pivoted at their upper ends in block 16 by pins 18 and 20. A handle 22 is integral with or fastened to block 16. In the lower end of leg 12 is mounted pointer 24 which is height-adjustable therein by means of clamp screw 26 which passes through an opening in tubular leg 12.

Mounted in the lower part of leg 14 by means of a separable pin and socket connector 28 is adapter 30 which is internally threaded at 32 to receive blade holder 34 for pointed generally planar blade 36.

As shown in FIG. 2, connector 28 has a tubular upper part or pin 38 received in the lower part of leg 14 which has clamp screw 40 for adjusting the length of the cutting means away from block 16. The lower end of connector 28 has a rounded radially projecting shoulder 42 which is captured in cavity 44 in the upper part of adaptor 30 through which passes clamp screw 46. This arrangement makes it possible for the adaptor to rotate about the axis of leg 14 so as to set blade 36 at an angle desired.

As shown in FIGS. 2 and 4, the lower end of blade holder 34 has a pair of elongated intersecting slits 48 and 50. After blade 36 is inserted in slit 50 of the holder, the same is screwed in the adaptor thereby tightening the outwardly flaring surfaces 52 of the holder against the inner surfaces of the bore 54 in adaptor 30. This clamping action secures blade 36 in the assembly.

In a modified version of the invention, the connector and the adaptor are made in one piece. The orientation of blade 36 then is obtained by turning blade holder 34.

The cutter of the invention operates like a compass with its pointer forming the center of the pieces cut by the blade. The angle of attack of the blade is easily varied, as needed.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

As various possible embodiments might be made of the above invention, and as various changes might be made in the embodiments above set forth, it is to be understood that all matter herein set forth or shown in the accompanying drawing is to be interpreted as illustrative and not in a limiting sense.

Having thus described my invention I claim as new and desire to secure by Letters Patent:

1. A device for cutting circles comprising: a pair of elongated legs; pivot means connecting upper ends of said legs for swinging movements; a pointer carried in the lower end of one of said legs; blade holding means; means for mounting said blade holding means to a lower end of the other of said legs for rotation about the axis of said other leg; a pointed generally planar blade fixedly carried projecting from said blade holding means; said blade holding means having a bore in the lower part thereof, said bore having a threaded upper portion and an unthreaded lower portion, a slitted member having slits at a lower portion thereof for fixedly carrying said blade and outwardly flaring surfaces in the area of said slits, said slitted member further having an upper threaded portion for connection to said threaded portion of said bore, the screwing of said threaded portions together resulting in tightening said flaring surfaces against the unthreaded lower portion of said bore thereby clamping said blade in said slits.

2. A device for cutting circles comprising: a pair of elongated legs; pivot means connecting upper ends of said legs for swinging movements; a pointer carried in the lower end of one of said legs; blade holding means; means for mounting said blade holding means to a lower end of the other of said legs for rotation about the axis of said other leg; a pointed generally planar blade fixedly carried projecting from said blade holding means; said mounting means comprising a separable connector means carried by said other leg; said connector means including a pin received in socket means carried by said other leg, said pin having a radially projecting shoulder at the lower part thereof; said blade holding means having a cavity in the upper part thereof configured for capture of said shoulder; and a screw carried threadably by said blade holding means for bearing on said shoulder.

3. The device of claim 2 wherein said blade holding means has a bore in the lower part thereof, said bore having a threaded upper portion and an unthreaded lower portion, a slitted member having slits at a lower portion thereof for fixedly carrying said blade and outwardly flaring surfaces in the area of said slits, said slitted member further having an upper threaded portion for connection to said threaded portion of said bore, the screwing of said threaded portions together resulting in tightening said flaring surfaces against the unthreaded lower portion of said bore thereby clamping said blade in said slits.

* * * * *